US009767766B2

(12) United States Patent
Oh et al.

(10) Patent No.: US 9,767,766 B2
(45) Date of Patent: Sep. 19, 2017

(54) DISPLAY APPARATUS AND METHOD OF OPERATING DISPLAY APPARATUS

(71) Applicant: SAMSUNG DISPLAY CO., LTD., Yongin, Gyeonggi-Do (KR)

(72) Inventors: Kwan-Young Oh, Hwaseong-si (KR); Sil-Yi Bang, Yongin-si (KR); Sang-Su Han, Seoul (KR); Jin-Hyun Ko, Yongin-si (KR); Jin-Kyu Park, Yongin-si (KR); Jae-Ho Choi, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 144 days.

(21) Appl. No.: 14/726,218

(22) Filed: May 29, 2015

(65) Prior Publication Data

US 2016/0125845 A1 May 5, 2016

(30) Foreign Application Priority Data

Nov. 4, 2014 (KR) ..... 10-2014-0152290

(51) Int. Cl.

| | |
|---|---|
| ***G09G 3/36*** | (2006.01) |
| ***G09G 5/12*** | (2006.01) |
| ***G09G 3/20*** | (2006.01) |

(52) U.S. Cl.

CPC ..... *G09G 5/12* (2013.01); *G09G 3/20* (2013.01); *G09G 3/3666* (2013.01); *G09G 3/3607* (2013.01); *G09G 2310/08* (2013.01)

(58) Field of Classification Search

None

See application file for complete search history.

(56) References Cited

U.S. PATENT DOCUMENTS 4,935,893 A * 6/1990 Currie ..... G09G 5/222 345/10
7,084,840 B2 * 8/2006 Moon ..... G09G 3/3611 345/100

(Continued)

FOREIGN PATENT DOCUMENTS

JP 6-274134 A 9/1994
KR 10-2007-0096914 A 10/2007

(Continued)

*Primary Examiner* — Chad Dicke

(74) *Attorney, Agent, or Firm* — Lewis Roca Rothgerber Christie LLP

(57) ABSTRACT

A display apparatus includes: a display panel including a first display area and a second display area; a first timing controller to control an operation of the first display area, generate a first reference clock signal, generate a first internal reference clock signal based on the first reference clock signal, and generate a first synchronization clock signal based on the first internal reference clock signal; and a second timing controller to control an operation of the second display area, receive the first reference clock signal, generate a second internal reference clock signal based on the first reference clock signal, and generate a second synchronization clock signal based on the second internal reference clock signal, wherein the first and second timing controllers are to be synchronized with each other based on the first reference clock signal, and exchange first data based on the first and second synchronization clock signals.

20 Claims, 10 Drawing Sheets

(56) References Cited

U.S. PATENT DOCUMENTS 8,605,026 B2 * 12/2013 Ko ..... G09G 3/3426 345/100
8,963,798 B2 * 2/2015 Lee ..... G06F 3/1438 345/1.1
8,994,700 B2 * 3/2015 Foster ..... G06F 3/1431 345/204
2006/0007114 A1 * 1/2006 Shiraishi ..... G09G 3/3611 345/103
2006/0197730 A1 * 9/2006 Ooga ..... G09G 3/3611 345/98
2007/0222774 A1 * 9/2007 Foster ..... G06F 3/1431 345/204
2009/0091527 A1 * 4/2009 Chung ..... G09G 3/2096 345/99
2009/0135169 A1 * 5/2009 Hiratsuka ..... G09G 3/3688 345/208
2010/0141850 A1 * 6/2010 Itoh ..... G09G 3/3677 348/731
2010/0302214 A1 * 12/2010 Kim ..... G09G 3/20 345/204
2011/0148852 A1 * 6/2011 Kim ..... G09G 3/20 345/213
2011/0157106 A1 * 6/2011 Kim ..... G06F 3/1431 345/204
2011/0242412 A1 * 10/2011 Lee ..... G06F 3/1438 348/500
2012/0086681 A1 * 4/2012 Kim ..... G09G 3/3648 345/204
2012/0127145 A1 * 5/2012 Jang ..... G09G 3/20 345/211
2012/0133635 A1 * 5/2012 Ji ..... G09G 3/3688 345/212
2013/0147782 A1 * 6/2013 Hsu ..... G09G 3/20 345/212
2014/0063392 A1 * 3/2014 Gondo ..... G09G 3/3611 349/41
2014/0160109 A1 * 6/2014 Chen ..... G09G 3/3685 345/213
2014/0184672 A1 * 7/2014 Chen ..... G02F 1/13306 345/698
2014/0204065 A1 * 7/2014 Park ..... G09G 5/18 345/204
2015/0269912 A1 * 9/2015 Chen ..... G06F 3/1446 345/699
2015/0325164 A1 * 11/2015 Kim ..... G09G 3/3607 345/694

FOREIGN PATENT DOCUMENTS

KR 10-2011-0108844 A 10/2011
KR 10-2012-0111583 A 10/2012
KR 10-2013-0038683 A 4/2013

* cited by examiner

DISPLAY APPARATUS AND METHOD OF OPERATING DISPLAY APPARATUS

CROSS-REFERENCE TO RELATED APPLICATION

This application claims priority under 35 USC §119 to, and the benefit of, Korean Patent Application No. 10-2014-0152290, filed on Nov. 4, 2014 in the Korean Intellectual Property Office (KIPO), the contents of which are herein incorporated by reference in their entirety.

BACKGROUND

1. Field

One or more example embodiments relate generally to display apparatuses and methods of operating the display apparatuses.

2. Description of the Related Art

Typically, a display apparatus includes a display panel and a timing controller. The timing controller controls overall operations of the display panel. For example, the timing controller may control the display panel to display an image on the display panel.

As the size of the display panel has increased, the amount of calculation for controlling the display panel has increased. To improve the performance of the display apparatus, a distributed processing in the display apparatus has been researched. For example, the display apparatus may include at least two timing controllers, and each timing controller may control at least a portion of the display panel.

The above information disclosed in this Background section is only for enhancement of understanding of the background of the present invention, and therefore, it may contain information that does not form prior art.

SUMMARY

At least one example embodiment of the present disclosure provides a display apparatus having a relatively improved performance.

At least one example embodiment of the present disclosure provides a method of operating the display apparatus.

According to example embodiments, a display apparatus includes: a display panel including a first display area and a second display area; a first timing controller configured to control an operation of the first display area, to generate a first reference clock signal, to generate a first internal reference clock signal based on the first reference clock signal, and to generate a first synchronization clock signal based on the first internal reference clock signal; and a second timing controller configured to control an operation of the second display area, to receive the first reference clock signal, to generate a second internal reference clock signal based on the first reference clock signal, and to generate a second synchronization clock signal based on the second internal reference clock signal. The first and second timing controllers are configured to be synchronized with each other based on the first reference clock signal, and to exchange first data with each other based on the first and second synchronization clock signals.

In an example embodiment, the first timing controller may be configured to output the first data based on the first synchronization clock signal, and the second timing controller may be configured to perform a data capture operation on the first data based on the first synchronization clock signal, the second internal reference clock signal and the second synchronization clock signal, when the first data is transmitted from the first timing controller to the second timing controller.

In an example embodiment, each of the first and second internal reference clock signals may have a frequency that is higher than a frequency of the first reference clock signal, each of the first and second synchronization clock signals may have a frequency that is lower than the frequency of each of the first and second internal reference clock signals, and the data capture operation may include a multi-phase capture operation.

In an example embodiment, the second timing controller may be configured to output the first data based on the second synchronization clock signal, and the first timing controller may be configured to perform a data capture operation on the first data based on the first synchronization clock signal, the first internal reference clock signal and the second synchronization clock signal, when the first data is transmitted from the second timing controller to the first timing controller.

In an example embodiment, the first and second timing controllers may be further configured to be synchronized with each other based on a first synchronization signal indicating that at least one selected from the first and second timing controllers enters a fail mode.

The first synchronization signal may be activated when at least one selected from the first and second timing controllers enters the fail mode, and the display apparatus may be configured to enter a system fail mode based on the activated first synchronization signal.

In an example embodiment, the first and second timing controllers may be further configured to be synchronized with each other based on a first synchronization signal indicating that both the first and second timing controllers are initialized.

The first synchronization signal may be activated when initializations for both the first and second timing controllers are completed, and the first synchronization signal may be deactivated when a vertical synchronization for the display panel is completed after the initializations for both the first and second timing controllers are completed.

In an example embodiment, the first synchronization signal may be periodically activated, and horizontal synchronizations for rows of the display panel may be performed after the vertical synchronization for the display panel is completed.

In an example embodiment, the first data may include first image data, and the first timing controller may be configured to transfer the first image data to the second timing controller based on the first synchronization clock signal while the first synchronization signal is activated.

In an example embodiment, the first image data may correspond to a boundary image that is displayed on a boundary area between the first display area and the second display area.

The first timing controller may be configured to operate as a master, and the second timing controller may be configured to operate as a slave.

In an example embodiment, the first timing controller may be configured to receive a first setting signal for determining the first timing controller as the master, and the second timing controller may be configured to receive a second setting signal for determining the second timing controller as the slave.

In an example embodiment, the first timing controller may be configured to be determined as the master based on a first internal parameter, and the second timing controller may be configured to be determined as the slave based on a second internal parameter.

In an example embodiment, the first timing controller may include: a first oscillator configured to generate the first reference clock signal; a first phase locked loop (PLL) configured to generate the first internal reference clock signal based on the first reference clock signal; a first synchronization clock signal generator configured to generate the first synchronization clock signal based on the first internal reference clock signal; a first data processing unit configured to perform a data processing operation based on the first internal reference clock signal and the first synchronization clock signal; and a first input/output (I/O) unit configured to output the first reference clock signal, and further configured to output the first data based on the first synchronization clock signal, or to receive the second synchronization clock signal and the first data.

In an example embodiment, the display apparatus may further include: at least one first data driver connected to the first timing controller and a plurality of first data lines in the first display area, the at least one first data driver configured to generate a plurality of first data voltages to apply the plurality of first data voltages to the plurality of first data lines; and at least one second data driver connected to the second timing controller and a plurality of second data lines in the second display area, the at least one second data driver configured to generate a plurality of second data voltages to apply the plurality of second data voltages to the plurality of second data lines.

According to example embodiments, a method of operating a display apparatus including a display panel including a first display area and a second display area, includes: synchronizing a second timing controller with a first timing controller based on a first reference clock signal, the first timing controller controlling an operation of the first display area, and the second timing controller controlling an operation of the second display area; and operating the display panel based on the synchronized first and second timing controllers. The synchronizing of the first and second timing controllers includes: generating the first reference clock signal; generating first and second internal reference clock signals based on the first reference clock signal; and generating first and second synchronization clock signals based on the first and second internal reference clock signals. The first and second timing controllers exchange first data with each other based on the first and second synchronization clock signals.

In an example embodiment, when the first data is transmitted from the first timing controller to the second timing controller, the first timing controller may output the first data based on the first synchronization clock signal, and the second timing controller may perform a data capture operation on the first data based on the first synchronization clock signal, the second internal reference clock signal, and the second synchronization clock signal.

In an example embodiment, each of the first and second internal reference clock signals may have a frequency that is higher than a frequency of the first reference clock signal, each of the first and second synchronization clock signals may have a frequency that is lower than the frequency of each of the first and second internal reference clock signals, and the data capture operation may include a multi-phase capture operation.

In an example embodiment, the first and second timing controllers may be further synchronized with each other based on at least one selected from a first synchronization signal and a second synchronization signal, the first synchronization signal may indicate that at least one selected from the first and second timing controllers enters a fail mode, and the second synchronization signal may indicate that both the first and second timing controllers are initialized.

In the display apparatus according to example embodiments, the first and second timing controllers may be synchronized with each other based on the first reference clock signal that may be generated in the first timing controller. The first and second timing controllers may be further synchronized with each other based on at least one selected from the first synchronization signal for a fail mode synchronization and the second synchronization signal for an initialization synchronization. In addition, the first and second timing controllers may exchange the first data with each other based on the first and second synchronization clock signals, and the multi-phase capture operation may be performed based on the first and second internal reference clock signals. Accordingly, the timing controllers may be efficiently synchronized with each other, and the display apparatus including the timing controllers may have a relatively improved performance.

BRIEF DESCRIPTION OF THE DRAWINGS

Illustrative, non-limiting example embodiments will be more clearly understood from the following detailed description taken in conjunction with the accompanying drawings.

DETAILED DESCRIPTION

Figure 1:
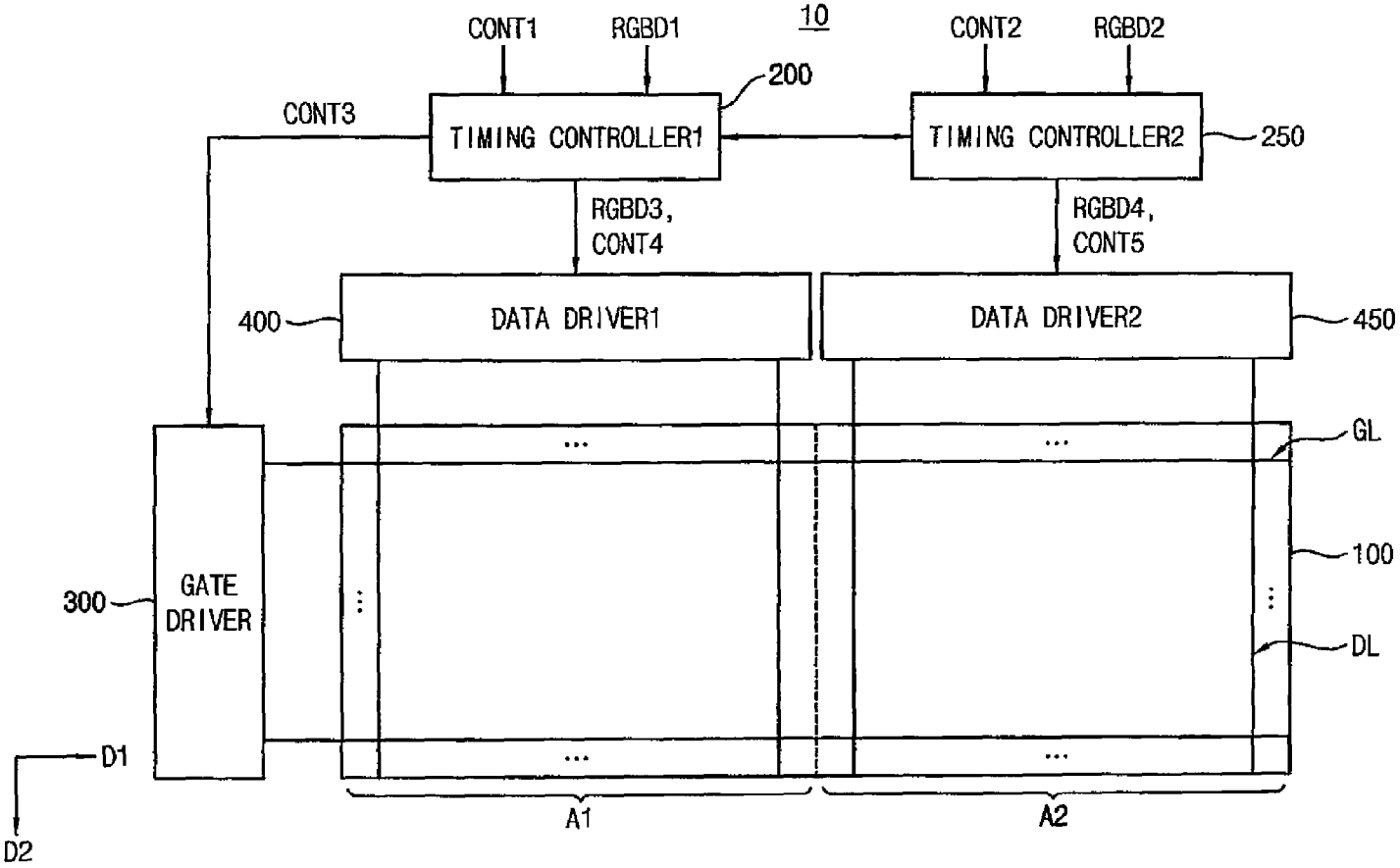
FIG. 1 is a block diagram illustrating a display apparatus according to example embodiments.

Various example embodiments will be described more fully with reference to the accompanying drawings, in which embodiments are shown. The present inventive concept may, however, be embodied in various different forms, and should not be construed as limited to the embodiments described herein. Rather, these embodiments are provided so that this disclosure will be thorough and complete, and will fully convey the spirit and scope of the inventive concept to those skilled in the art. Like reference numerals refer to like elements throughout this application.

It will be understood that, although the terms first, second, etc. may be used herein to describe various elements, these elements should not be limited by these terms. These terms are used to distinguish one element from another. For example, a first element could be termed a second element, and, similarly, a second element could be termed a first element, without departing from the spirit and scope of the inventive concept. As used herein, the term "and/or" includes any and all combinations of one or more of the associated listed items. Expressions such as "at least one of," when preceding a list of elements, modify the entire list of elements and do not modify the individual elements of the list.

It will be understood that when an element is referred to as being "connected" or "coupled" to another element, it can be directly connected or coupled to the other element or one or more intervening elements may be present. When an element is referred to as being "directly connected" or "directly coupled" to another element, there are no intervening elements present. Other words used to describe the relationship between elements should be interpreted in a like fashion (e.g., "between" versus "directly between," "on" versus "directly on," etc.).

The terminology used herein is for the purpose of describing particular embodiments and is not intended to be limiting of the inventive concept. As used herein, the singular forms "a" and "an" are intended to include the plural forms as well, unless the context clearly indicates otherwise. It will be further understood that the terms "comprises," "comprising," "includes" and "including," when used herein, specify the presence of stated features, integers, steps, operations, elements, and/or components, but do not preclude the presence or addition of one or more other features, integers, steps, operations, elements, components and/or groups thereof.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense, unless expressly so defined herein.

FIG. 1 is a block diagram illustrating a display apparatus according to some example embodiments.

Referring to FIG. 1, a display apparatus 10 includes a display panel 100, a first timing controller 200, a second timing controller 250, a gate driver 300, a first data driver 400, and a second data driver 450.

The display panel 100 is connected to a plurality of gate lines GL and a plurality of data lines DL. The display panel 100 displays an image having a plurality of gray levels (e.g., grayscale levels) based on output image data RGBD3 and RGBD4. The gate lines GL may extend in a first direction D1, and the data lines DL may extend in a second direction D2 crossing (e.g., substantially perpendicular to) the first direction D1.

The display panel 100 may include a plurality of pixels that are arranged in a matrix form. Each pixel may be electrically connected to a respective one of the gate lines GL and a respective one of the data lines DL.

Each pixel may include a switching element, a liquid crystal capacitor, and a storage capacitor. The liquid crystal capacitor and the storage capacitor may be electrically connected to the switching element. For example, the switching element may be a thin film transistor. The liquid crystal capacitor may include a first electrode connected to a pixel electrode and a second electrode connected to a common electrode. A data voltage may be applied to the first electrode of the liquid crystal capacitor. A common voltage may be applied to the second electrode of the liquid crystal capacitor. The storage capacitor may include a first electrode connected to the pixel electrode and a second electrode connected to a storage electrode. The data voltage may be applied to the first electrode of the storage capacitor. A storage voltage may be applied to the second electrode of the storage capacitor. The storage voltage may be substantially equal to the common voltage.

Each pixel may have a generally rectangular shape. For example, each pixel may have a relatively short side in the first direction D1 and a relatively long side in the second direction D2. The relatively short side of each pixel may be substantially parallel to the gate lines GL. The relatively long side of each pixel may be substantially parallel to the data lines DL.

The display panel 100 is divided into a first display area A1 and a second display area A2. The first display area A1 may operate based on controls of the first timing controller 200 and the first data driver 400. The second display area A2 may operate based on controls of the second timing controller 250 and the second data driver 450.

The timing controllers 200 and 250 control an operation of the display panel 100, and control operations of the gate driver 300 and the data drivers 400 and 450. The first timing controller 200 receives first input image data RGBD1 and a first input control signal CONT1 from an external device (e.g., a host). The second timing controller 250 receives second input image data RGBD2 and a second input control signal CONT2 from the external device. Each of the input image data RGBD1 and RGBD2 may include a plurality of input pixel data for the plurality of pixels. Each input pixel data may include red grayscale data R, green grayscale data G, and blue grayscale data B for a respective one of the plurality of pixels. Each of the input control signals CONT1 and CONT2 may include a master clock signal, a data enable signal, a vertical synchronization signal, a horizontal synchronization signal, etc.

The first timing controller 200 controls an operation of the first display area A1 of the display panel 100, and generates the first output image data RGBD3, a first control signal CONT3, and a second control signal CONT4 based on the first input image data RGBD1 and the first input control signal CONT1. The second timing controller 250 controls an operation of the second display area A2 of the display panel 100, and generates the second output image data RGBD4, and a third control signal CONT5 based on the second input image data RGBD2 and the second input control signal CONT2.

For example, the first timing controller 200 may generate the first output image data RGBD3 based on the first input image data RGBD1. The first output image data RGBD3 may be provided to the first data driver 400. The first timing controller 200 may generate the first control signal CONT3 based on the first input control signal CONT1. The first control signal CONT3 may be provided to the gate driver 300, and a driving timing of the gate driver 300 may be controlled based on the first control signal CONT3. The first timing controller 200 may generate the second control signal CONT4 based on the first input control signal CONT1. The second control signal CONT4 may be provided to the first data driver 400, and a driving timing of the first data driver 400 may be controlled based on the second control signal CONT4. The second timing controller 250 may generate the second output image data RGBD4 based on the second input image data RGBD2. The second output image data RGBD4 may be provided to the second data driver 450. The second timing controller 250 may generate the third control signal CONT5 based on the second input control signal CONT2. The third control signal CONT5 may be provided to the second data driver 450, and a driving timing of the second data driver 450 may be controlled based on the third control signal CONT5.

In some example embodiments, the output image data RGBD3 and RGBD4 may be image data that are substantially the same as the input image data RGBD1 and RGBD2, respectively. In other example embodiments, the output image data RGBD3 and RGBD4 may be compensated image data that are generated by compensating the input image data RGBD1 and RGBD2, respectively. Similar to the input image data RGBD1 and RGBD2, each of the output image data RGBD3 and RGBD4 may include a plurality of output pixel data for the plurality of pixels. The first control signal CONT3 may include a vertical start signal, a gate clock signal, etc. Each of the second and third control signals CONT4 and CONT5 may include a horizontal start signal, a data clock signal, a data load signal, a polarity control signal, etc.

In some example embodiments, the first timing controller 200 may operate as a master, and the second timing controller 250 may operate as a slave. For example, the first and second timing controllers 200 and 250 may be synchronized with each other based on a reference clock signal that is generated in the first timing controller 200. The first and second timing controllers 200 and 250 may exchange data with each other based on synchronization clock signals that are generated based on the reference clock signal.

Detailed configurations and operations of the timing controllers 200 and 250 will be described below with reference to FIGS. 2 through 8.

The gate driver 300 receives the first control signal CONT3 from the first timing controller 200. The gate driver 300 generates a plurality of gate signals for driving the gate lines GL based on the first control signal CONT3. The gate driver 300 may sequentially apply the plurality of gate signals to the gate lines GL.

The first data driver 400 is connected to the first timing controller 200 and is connected to a plurality of first data lines that are disposed in the first display area A1. The first data driver 400 receives the second control signal CONT4 and the first output image data RGBD3 from the first timing controller 200. The first data driver 400 generates a plurality of first data voltages (e.g., analog data voltages) based on the second control signal CONT4 and the first output image data RGBD3 (e.g., digital image data). The first data driver 400 may apply the plurality of first data voltages to the first data lines.

The second data driver 450 is connected to the second timing controller 250 and is connected to a plurality of second data lines that are disposed in the second display area A2. The second data driver 450 receives the third control signal CONT5 and the second output image data RGBD4 from the second timing controller 250. The second data driver 450 generates a plurality of second data voltages (e.g., analog data voltages) based on the third control signal CONT5 and the second output image data RGBD4 (e.g., digital image data). The second data driver 450 may apply the plurality of second data voltages to the second data lines.

In some example embodiments, each of the data drivers 400 and 450 may include a shift register, a latch, a signal processor, and a buffer. The shift register may output a latch pulse to the latch. The latch may store (e.g., temporarily store) the output image data, and may output the output image data to the signal processor. The signal processor may generate the data voltages (e.g., analog data voltages) based on the output image data (e.g., digital output image data), and may output the data voltages to the buffer. The buffer may output the data voltages to the data lines.

In some example embodiments, the gate driver 300 and/or the data drivers 400 and 450 may be disposed, e.g., directly mounted, on the display panel 100, or may be connected to the display panel 100 in a tape carrier package (TCP) type. Alternatively, the gate driver 300 and/or the data drivers 400 and 450 may be integrated on the display panel 100.

Although FIG. 1 illustrates an example where the display apparatus 10 includes a single first data driver 400 and a single second data driver 450, the display apparatus according to some example embodiments may include a plurality of first data drivers and a plurality of second data drivers. The plurality of first data drivers may be connected to the first timing controller 200 and the plurality of first data lines. The plurality of first data drivers may generate the plurality of first data voltages to apply the plurality of first data voltages to the plurality of first data lines. The plurality of second data drivers may be connected to the second timing controller 250 and the plurality of second data lines. The plurality of second data drivers may generate the plurality of second data voltages to apply the plurality of second data voltages to the plurality of second data lines.

Although FIG. 1 shows a single gate driver 300, the present inventive concept is not limited thereto, and the display apparatus according to some example embodiments may include at least two gate drivers.

Figure 2:
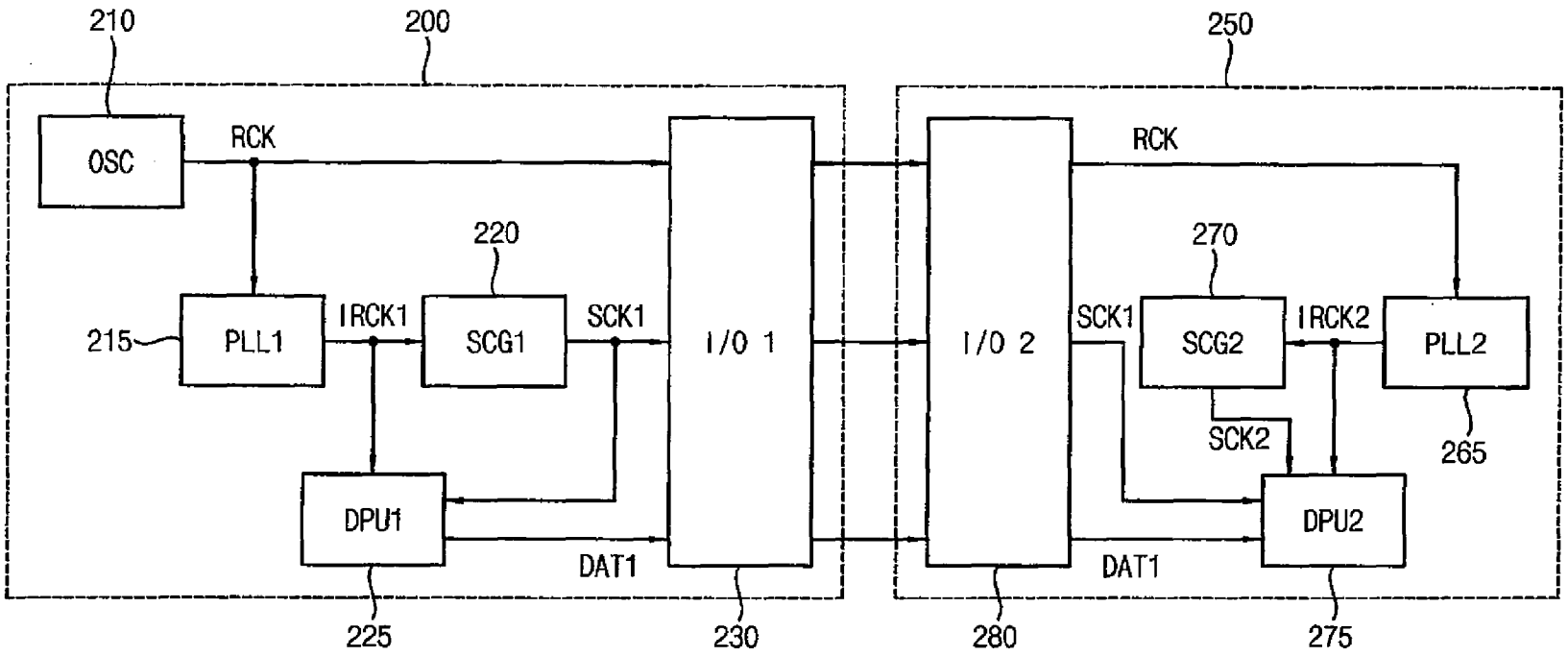
FIG. 2 is a block diagram illustrating timing controllers included in the display apparatus according to example embodiments.

FIG. 2 is a block diagram illustrating timing controllers included in the display apparatus according to some example embodiments.

FIG. 2 illustrates components for synchronizing the second timing controller 250 with the first timing controller 200. Some components (e.g., components for generating the output image data RGBD3 and RGBD4 in FIG. 1, and the control signals CONT3, CONT4, and CONT5 in FIG. 1) of the timing controllers 200 and 250 are omitted in FIG. 2 for convenience of illustration.

Referring to FIG. 2, the first timing controller 200 generates a first reference clock signal RCK, generates a first internal reference clock signal IRCK1 based on the first reference clock signal RCK, and generates a first synchronization clock signal SCK1 based on the first internal reference clock signal IRCK1. The second timing controller 250 receives the first reference clock signal RCK from the first timing controller 200, generates a second internal reference clock signal IRCK2 based on the first reference clock signal RCK, and generates a second synchronization clock signal SCK2 based on the second internal reference clock signal IRCK2.

The first and second timing controllers 200 and 250 are synchronized with each other based on the first reference clock signal RCK. In other words, the second timing controller 250 is synchronized with the first timing controller 200 based on the first reference clock signal RCK. As described above, the first and second timing controllers 200 and 250 may generate driving clock signals (e.g., IRCK1, IRCK2, SCK1, and SCK2) based on one reference clock signal RCK, and thus, clock synchronizations between the timing controllers 200 and 250 may be reliable. As will be described below with reference to FIGS. 5 and 7, the first and second timing controllers 200 and 250 may be further synchronized with each other based on at least one selected from a first synchronization signal FSS and a second synchronization signal RSS.

The first and second timing controllers 200 and 250 exchange first data DAT1 with each other based on the first and second synchronization clock signals SCK1 and SCK2. In other words, the first timing controller 200 exchanges the first data DAT1 with the second timing controller 250 based on the first and second synchronization clock signals SCK1 and SCK2. As described above, the first and second timing controllers 200 and 250 may exchange data with each other based on the synchronized clock signals, and thus, data synchronizations between the timing controllers 200 and 250 may be reliable. For example, the first data DAT1 may include image data (e.g., data corresponding to a boundary image that is displayed on a boundary area between the first display area A1 and the second display area A2), test pattern data, dithering data, data for an inversion driving scheme, data for any synchronization operation, etc.

In the example embodiment shown in FIG. 2, the first data DAT1 may be transmitted from the first timing controller 200 to the second timing controller 250. In this case, the first timing controller 200 may output the first data DAT1 based on the first synchronization clock signal SCK1. The second timing controller 250 may perform a data capture operation on the first data DAT1 based on the first synchronization clock signal SCK1, the second internal reference clock signal IRCK2, and the second synchronization clock signal SCK2.

Figure 3:
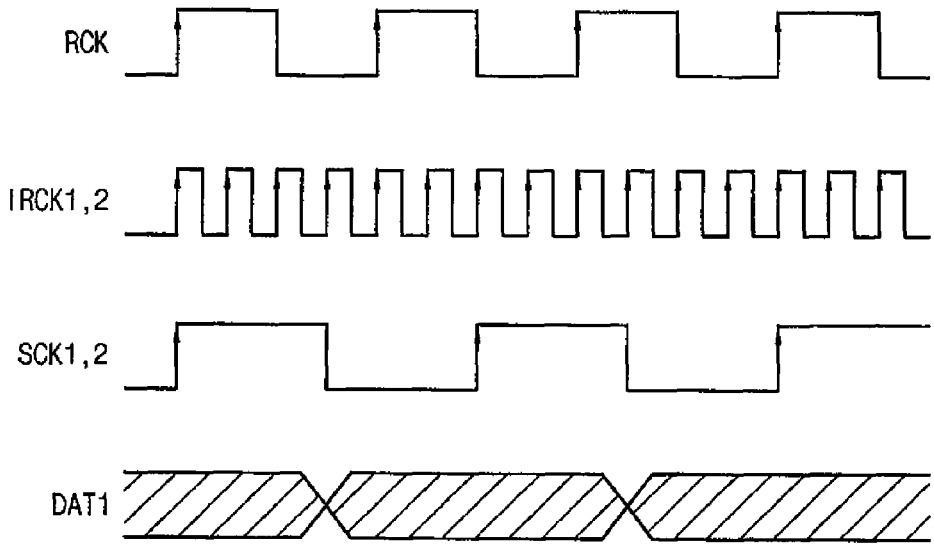
FIG. 3 is a timing diagram illustrating a data capture operation performed by the timing controllers shown in FIG. 2.

FIG. 3 is a timing diagram illustrating a data capture operation performed by the timing controllers shown in FIG. 2.

Referring to FIG. 3, each of the first and second internal reference clock signals IRCK1 and IRCK2 may have a frequency, which is higher than a frequency of the first reference clock signal RCK1. The frequency of the first internal reference clock signal IRCK1 may be substantially the same as the frequency of the second internal reference clock signal IRCK2.

Each of the first and second synchronization clock signals SCK1 and SCK2, which is generated based on each of the first and second internal reference clock signals IRCK1 and IRCK2, may have a frequency that is lower than the frequency of each of the first and second internal reference clock signals IRCK1 and IRCK2. The frequency of the first synchronization clock signal SCK1 may be substantially the same as the frequency of the second synchronization clock signal SCK2. Since the first data DAT1 is transmitted based on the first synchronization clock signal SCK1, a transmission frequency of the first data DAT1 may be substantially the same as the frequency of each of the first and second synchronization clock signals SCK1 and SCK2.

In some example embodiments, the data capture operation for the first data DAT1 may be a multi-phase capture operation. In other words, a single value in the first data DAT1 may be captured several times based on the second internal reference clock signal IRCK2 that has the frequency higher than the transmission frequency of the first data DAT1. Thus, the captured data (e.g., the captured value) may have a relatively improved reliability and a relatively improved integrity.

Although FIG. 3 illustrates an example where the data capture operation is performed based on rising edges of the clock signals, the data capture operation may be performed based on falling edges of the clock signals or based on both rising and failing edges of the clock signals.

Referring back to FIG. 2, the first timing controller 200 may include a first oscillator 210, a first phase locked loop (PLL) 215, a first synchronization clock signal generator 220, a first data processing unit 225, and a first input/output (I/O) unit 230.

The first oscillator 210 may generate the first reference clock signal RCK. The first PLL 215 may generate the first internal reference clock signal IRCK1 based on the first reference clock signal RCK. The first synchronization clock signal generator 220 may generate the first synchronization clock signal SCK1 based on the first internal reference clock signal IRCK1. The first data processing unit 225 may perform a data processing operation based on the first internal reference clock signal IRCK1 and the first synchronization clock signal SCK1. The first data processing unit 225 may generate the first data DAT1 that is transmitted to the second timing controller 250. The first I/O unit 230 may output the first reference clock signal RCK, and may output the first data DAT1 based on the first synchronization clock signal SCK1. Although not illustrated in FIG. 2, the first data processing unit 225 may further perform the data processing and capture operations on the first input image data RGBD1 in FIG. 1 based on the first internal reference clock signal IRCK1 and the first synchronization clock signal SCK1.

The second timing controller 250 may include a second PLL 265, a second synchronization clock signal generator 270, a second data processing unit 275, and a second I/O unit 280.

The second PLL 265 may generate the second internal reference clock signal IRCK2 based on the first reference clock signal RCK. The second synchronization clock signal generator 270 may generate the second synchronization clock signal SCK2 based on the second internal reference clock signal IRCK2. The second data processing unit 275 may perform the data capture operation on the first data DAT1 based on the first synchronization clock signal SCK1, the second internal reference clock signal IRCK2, and the second synchronization clock signal SCK2. The second I/O unit 280 may receive the first reference clock signal RCK, the first synchronization clock signal SCK1, and the first data DAT1. Although not illustrated in FIG. 2, the second data processing unit 275 may further perform the data processing and capture operations on the second input image data RGBD2 in FIG. 1 based on the second internal reference clock signal IRCK2 and the second synchronization clock signal SCK2.

Figure 4:
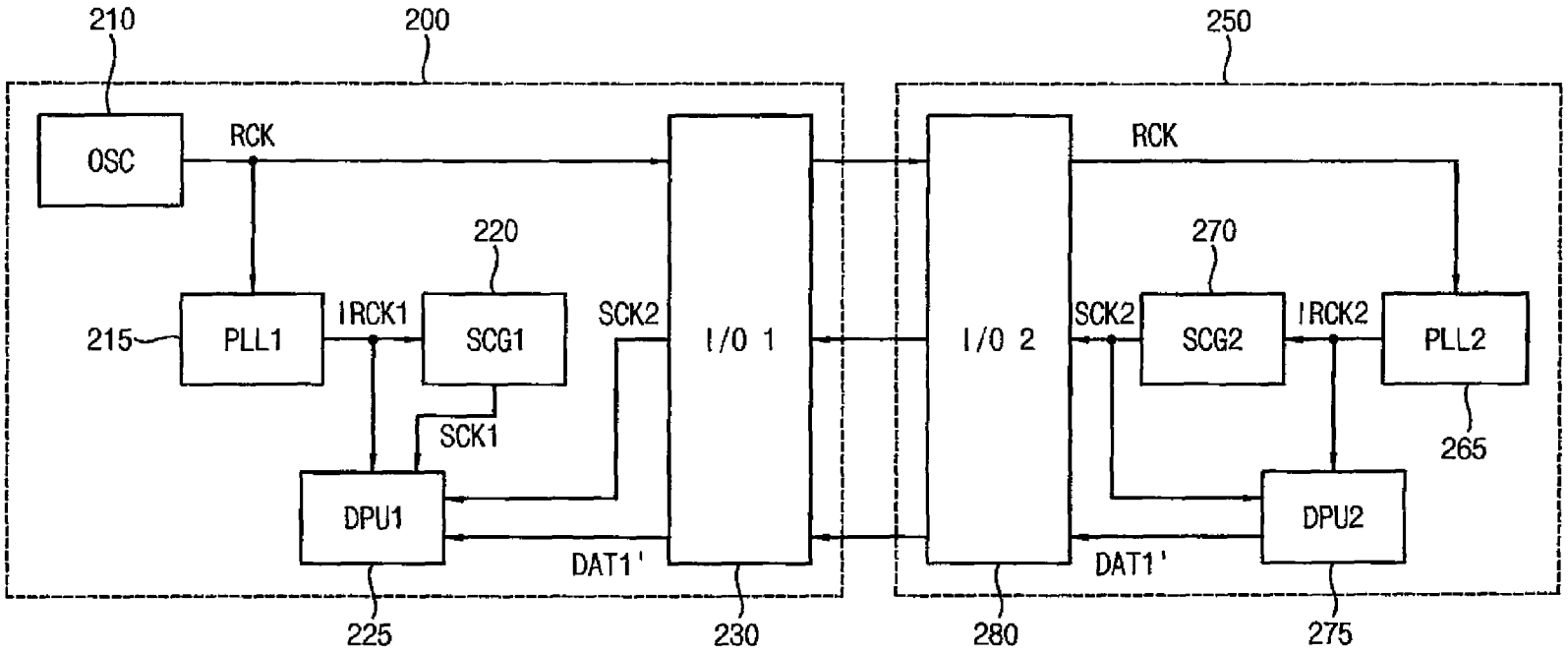
FIG. 4 is a block diagram illustrating timing controllers included in the display apparatus according to example embodiments.

FIG. 4 is a block diagram illustrating timing controllers included in the display apparatus according to some example embodiments.

The timing controllers 200 and 250 in FIG. 4 may be substantially the same as the timing controllers 200 and 250 in FIG. 2, respectively, except that first data DAT1' is transmitted from the second timing controller 250 to the first timing controller 200, and the operations of the data processing units and I/O units are changed.

Referring to FIG. 4, the first and second timing controllers 200 and 250 are synchronized with each other based on the first reference clock signal RCK, and exchange first data DAT1' with each other based on the first and second synchronization clock signals SCK1 and SCK2. In other words, the second timing controller 250 is synchronized with the first timing controller 200 based on the first reference clock signal RCK, and the second timing controller 250 exchanges the first data DAT1' with the first timing controller 200 based on the first and second synchronization clock signals SCK1 and SCK2.

In the example embodiment shown in FIG. 4, the first data DAT1' may be transmitted from the second timing controller 250 to the first timing controller 200. In this case, the second timing controller 250 may output the first data DAT1' based on the second synchronization clock signal SCK2. The first timing controller 200 may perform the data capture operation on the first data DAT1' based on the first synchronization clock signal SCK1, the first internal reference clock signal IRCK1, and the second synchronization clock signal SCK2. The data capture operation may be substantially the same as the example embodiment described above with reference to FIG. 3.

The second data processing unit 275 may perform the data processing operation based on the second internal reference clock signal IRCK2 and the second synchronization clock signal SCK2. The second data processing unit 275 may generate the first data DAT1' that is transmitted to the first timing controller 200. The second I/O unit 280 may receive the first reference clock signal RCK, and may output the first data DAT1' based on the second synchronization clock signal SCK2. The first data processing unit 225 may perform the data capture operation on the first data DAT1' based on the first synchronization clock signal SCK1, the first internal reference clock signal IRCK1, and the second synchronization clock signal SCK2. The first I/O unit 230 may output the first reference clock signal RCK, and may receive the second synchronization clock signal SCK2 and the first data DAT1'.

Although not illustrated in FIGS. 2 and 4, each of the first and second timing controllers 200 and 250 may include a control signal generator, an image processing unit, etc. The control signal generator may generate at least one selected from the control signals CONT3, CONT4, and CONT5 in FIG. 1. The image processing unit may perform at least one selected from an image quality compensation, a spot compensation, an adaptive color correction (ACC), and a dynamic capacitance compensation (DCC) for the input image data RGBD1 and RGBD2 in FIG. 1.

In addition, although not illustrated in FIGS. 2 and 4, the second timing controller 250 may further include a second oscillator. Although FIGS. 2 and 4 illustrate the example where the first timing controller 200 operates as the master and the second timing controller 250 operates as the slave, the second timing controller 250 may operate as the master and the first timing controller 200 may operate as the slave. In this case, the second timing controller 250 may provide a second reference clock signal generated from the second oscillator to the first timing controller 200, and the first and second timing controllers 200 and 250 may be synchronized with each other based on the second reference clock signal.

Figure 5:
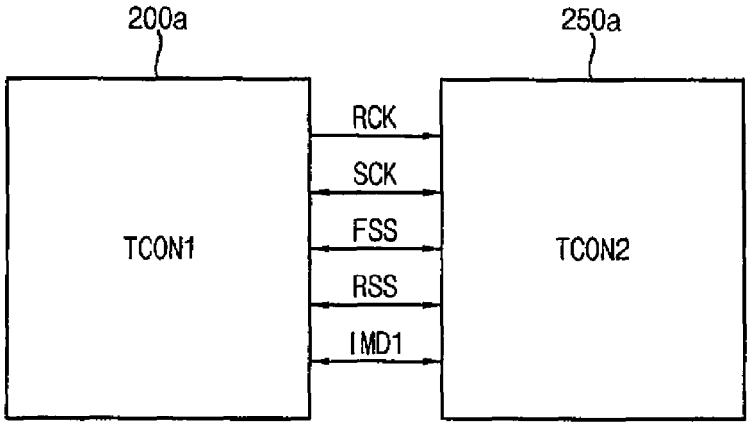
FIG. 5 is a block diagram illustrating timing controllers included in the display apparatus according to example embodiments.

FIG. 5 is a block diagram illustrating timing controllers included in the display apparatus according to some example embodiments.

Referring to FIG. 5, first and second timing controllers 200*a* and 250*a* are synchronized with each other based on a first reference clock signal RCK, and exchange first data with each other based on a synchronization clock signal SCK. The first and second timing controllers 200*a* and 250*a* in FIG. 5 may be similar to or substantially the same as the first and second timing controllers 200 and 250 shown in FIGS. 2 and 4, respectively.

The first and second timing controllers 200*a* and 250*a* may be further synchronized with each other based on at least one selected from a first synchronization signal FSS and a second synchronization signal RSS. The first synchronization signal FSS may indicate that at least one selected from the first and second timing controllers 200*a* and 250*a* enters a fail mode. The second synchronization signal RSS may indicate that both the first and second timing controllers 200*a* and 250*a* are initialized.

Figure 6:
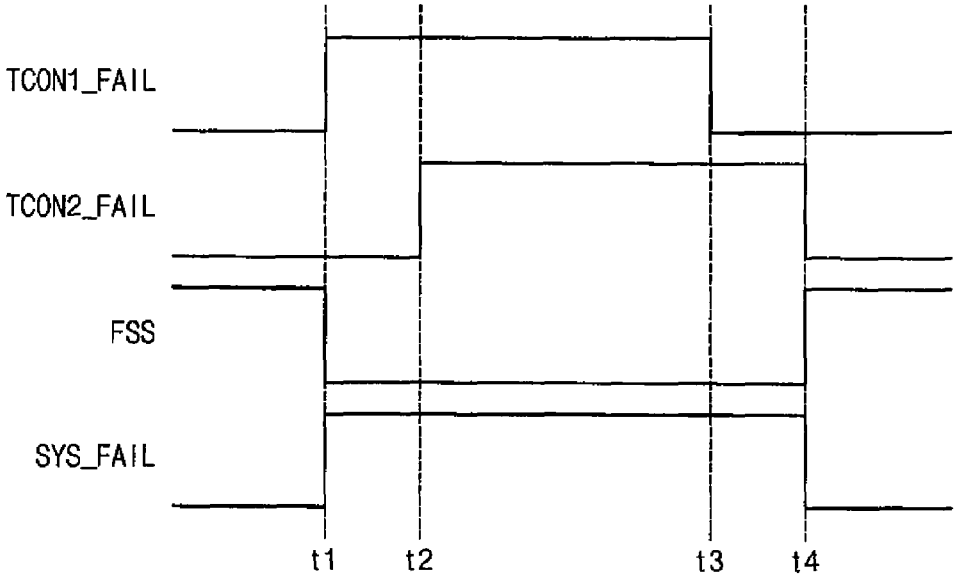
FIGS. 6, 7, and 8 are timing diagrams illustrating operations of the timing controllers shown in FIG. 5.
Figure 7:
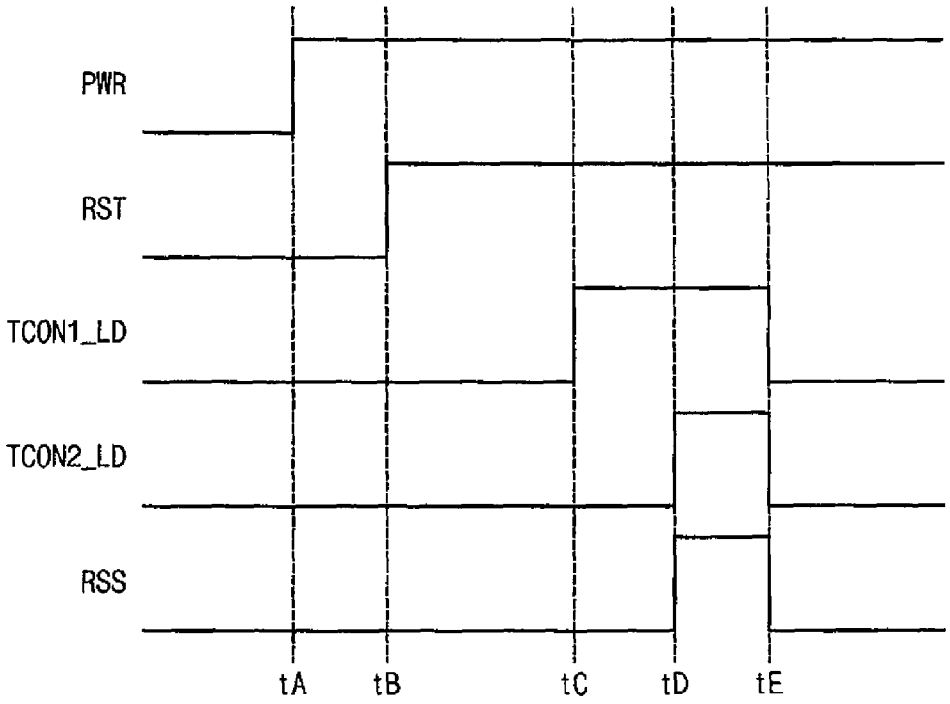
Figure 8:
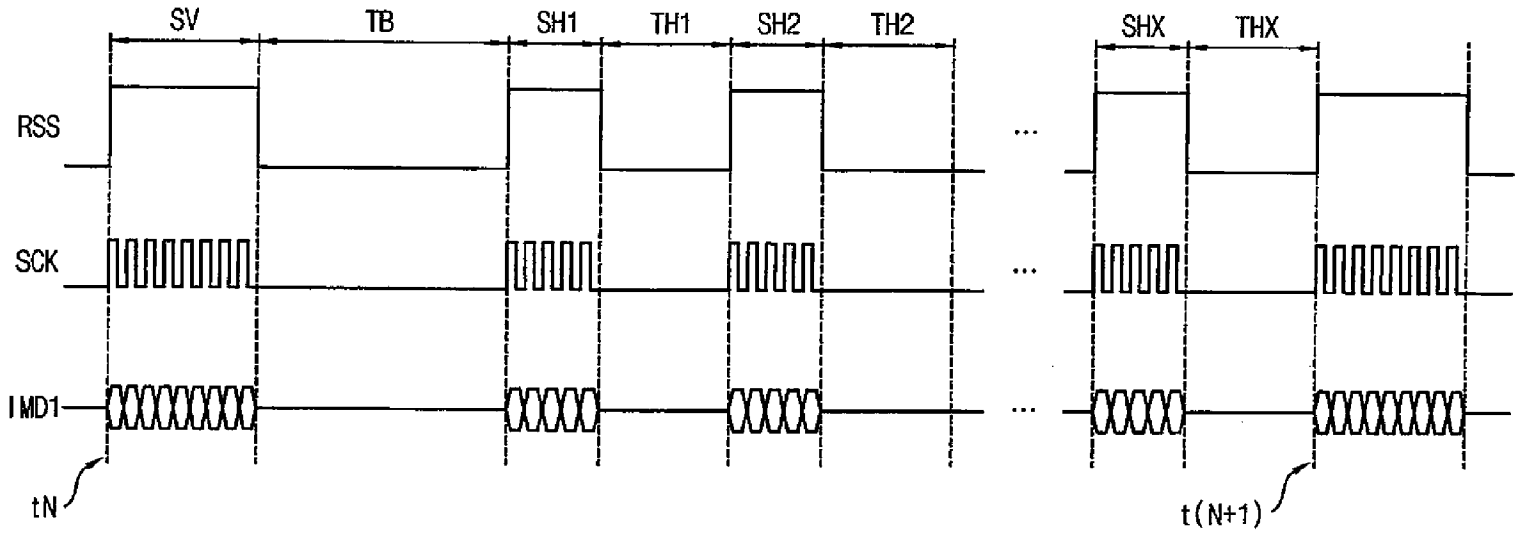

FIGS. 6, 7, and 8 are timing diagrams illustrating operations of the timing controllers shown in FIG. 5.

Referring to FIGS. 5 and 6, when at least one selected from the first and second timing controllers 200*a* and 250*a* enters the fail mode, the first synchronization signal FSS may be activated. The display apparatus 10 show in FIG. 1 may enter a system fail mode based on the activated first synchronization signal FSS.

For example, at time t1, the first timing controller 200*a* complies with a fail mode enable condition to enter the fail mode (e.g., TCON1_FAIL=logic high level), the first synchronization signal FSS is activated (e.g., FSS=logic low level), and the display apparatus 10 shown in FIG. 1 enters the system fail mode (e.g., SYS_FAIL=logic high level). The second timing controller 250*a* recognizes, based on the first synchronization signal FSS, that the first timing controller 200*a* enters the fail mode. At time t2, the second timing controller 250*a* enters the fail mode (e.g., TCON2_FAIL=logic high level). At time t3, the first timing controller 200*a* escapes (e.g., exits) from the fail mode (e.g., TCON1_FAIL=logic low level). At time t4, the second timing controller 250*a* escapes from the fail mode (e.g., TCON2_FAIL=logic low level). When both the first and second timing controllers 200*a* and 250*a* escape from the fail mode (e.g., at time t4 at which both TCON1_FAIL and TCON2_FAIL have the logic low level), the first synchronization signal FSS is deactivated (e.g., FSS=logic high level), and the display apparatus 10 shown in FIG. 1 escapes from the system fail mode (e.g., SYS_FAIL=logic low level).

Referring to FIGS. 5 and 7, when initializations for both the first and second timing controllers 200*a* and 250*a* are completed, the second synchronization signal RSS may be activated. When a vertical synchronization for the display panel 100 shown in FIG. 1 is completed after the initializations for both the first and second timing controllers 200*a* and 250*a* are completed, the second synchronization signal RSS may be deactivated.

For example, at time tA, power is supplied to the display apparatus 10 shown in FIG. 1 (e.g., PWR=logic high level). At time tB, an initialization signal is activated (e.g., RST=logic high level), and the first and second timing controllers 200*a* and 250*a* load initial setting values from an internal storage (e.g., an electrically erasable programmable read-only memory (EEPROM)). At time tC, a loading operation (e.g., an initialization operation) for the first timing controller 200*a* is completed (e.g., TCON1_LD=logic high level). At time tD, a loading operation (e.g., an initialization operation) for the second timing controller 250*a* is completed (e.g., TCON2_LD=logic high level). When the initializations for both the first and second timing controllers 200*a* and 250*a* are completed (e.g., at time tD at which both TCON1_LD and TCON2_LD have the logic high level), the second synchronization signal RSS is activated (e.g., RSS=logic high level), and then the vertical synchronization for the display panel 100 shown in FIG. 1 starts to perform. When the vertical synchronization for the display panel 100 in FIG. 1 is completed (e.g., at time tE at which both TCON1_LD and TCON2_LD have the logic low level), the second synchronization signal RSS is deactivated (e.g., RSS=logic low level).

Referring to FIGS. 5 and 8, at time tN, an operation for displaying an N-th frame on the display panel 100 shown in FIG. 1 starts to perform, where N is a natural number. During a period SV, the second synchronization signal RSS is activated, and then the vertical synchronization for the display panel 100 shown in FIG. 1 is performed. The period SV in FIG. 8 may be substantially the same as a period from time tD to time tE shown in FIG. 7. During a period TB after the vertical synchronization, the display panel 100 shown in FIG. 1 displays a black image.

After the vertical synchronization for the display panel 100 shown in FIG. 1 is completed, the second synchronization signal RSS may be periodically activated, and horizontal synchronizations for rows of the display panel 100 shown in FIG. 1 may be performed. For example, during a period SH1, a first horizontal synchronization for a first row of the display panel 100 shown in FIG. 1 is performed. During a period TH1 after the first horizontal synchronization, the display panel 100 shown in FIG. 1 displays a first row of a desired image. Similarly, during a period SH2, a second horizontal synchronization for a second row of the display panel 100 shown in FIG. 1 is performed. During a period TH2 after the second horizontal synchronization, the display panel 100 shown in FIG. 1 displays a second row of the desired image. During a period SHX, an X-th horizontal synchronization for an X-th row of the display panel 100 shown in FIG. 1 is performed, where X is a natural number. During a period THX after the X-th horizontal synchronization, the display panel 100 shown in FIG. 1 displays an X-th row of the desired image.

At time t(N+1), an operation for displaying an (N+1)-th frame that is subsequent to the N-th frame on the display panel 100 shown in FIG. 1 starts to perform.

In some example embodiments, the first data exchanged by the first and second timing controllers 200*a* and 250*a* may include first image data IMD1. While the second synchronization signal RSS is activated (e.g., during the periods SV, SH1, SH2 and/or SHX), the first and second timing controllers 200*a* and 250*a* may exchange the first image data IMD1 with each other based on the synchronization clock signal SCK. For example, the first image data IMD1 may be transmitted from the first timing controller 200*a* to the second timing controller 250*a* based on the first synchronization clock signal SCK1. For another example, the first image data IMD1 may be transmitted from the second timing controller 250*a* to the first timing controller 200*a* based on the second synchronization clock signal SCK2.

In some example embodiments, the first image data IMD1 may correspond to a boundary image that is displayed on a boundary area between the first display area A1 shown in FIG. 1 and the second display area A2 shown in FIG. 1. As will be described below with reference to FIG. 9, when the display panel 100 shown in FIG. 1 has a zigzag configuration, the display panel may efficiently display an image by transmitting the first image data IMD1 corresponding to the boundary image from the first timing controller 200*a* to the second timing controller 250*a*.

Figure 9:
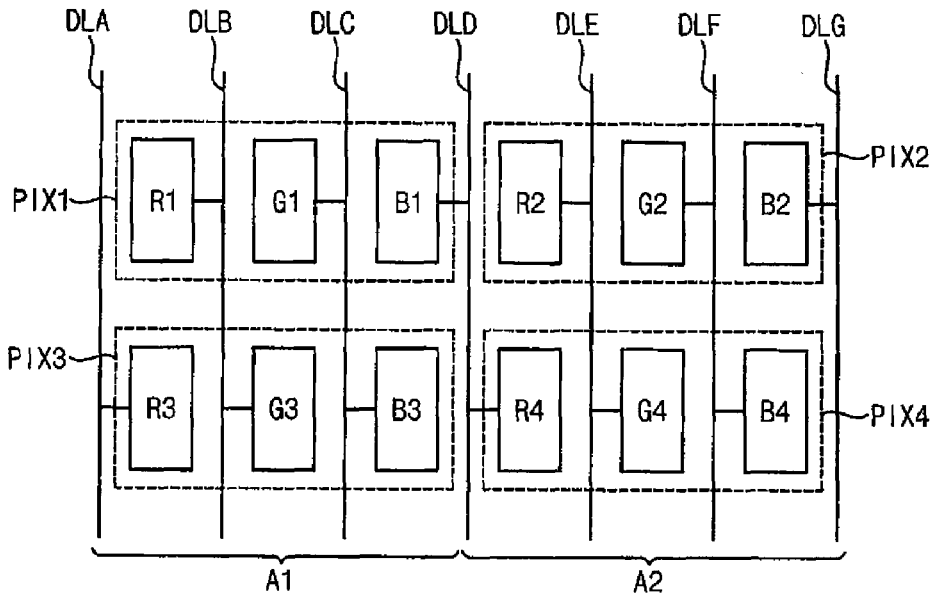
FIG. 9 is a diagram illustrating a display panel included in the display apparatus according to example embodiments.

FIG. 9 is a diagram illustrating a display panel included in the display apparatus according to some example embodiments.

Referring to FIG. 9, the display panel may include a plurality of pixels PIX1, PIX2, PIX3, and PIX4. Each pixel may include three subpixels. For example, the pixel PIX1 may include subpixels R1, G1, and B1. The pixel PIX2 may include subpixels R2, G2, and B2. The pixel PIX3 may include subpixels R3, G3, and B3. The pixel PIX4 may include subpixels R4, G4, and B4.

The subpixels R1~R4, G1~G4, and B1~B4 may be connected to data lines DLA, DLB, DLC, DLD, DLE, DLF, and DLG in the zigzag configuration, depending on rows in which the subpixels R1~R4, G1~G4, and B1~B4 are disposed. For example, each of the data lines DLA~DLG may be, alternately in a column direction, connected to one subpixel at a left side with respect to each of the data lines DLA~DLG, or may be connected to one subpixel at a right side with respect to each of the data lines DLA-DLG. For example, the subpixels R1, G1, B1, R2, G2, and B2 that are disposed in a first row may be connected to the data lines DLB, DLC, DLD, DLE, DLF, and DLG that are disposed at a right side with respect to the subpixels R1, G1, B1, R2, G2, and B2, respectively. The subpixels R3, G3, B3, R4, G4, and B4 that are disposed in a second row may be connected to the data lines DLA, DLB, DLC, DLD, DLE and, DLF that are disposed at a left side with respect to the subpixels R3, G3, B3, R4, G4, and B4, respectively.

As described above with reference to FIG. 1, the display panel may be divided into the first display area A1 and the second display area A2. In the example of FIG. 9, the pixels PIX1 and PIX3 may be disposed in the first display area A1, and the pixels PIX2 and PIX4 may be disposed in the second display area A2. The data lines DLA, DLB, and DLC may be driven based on the first timing controller 200 in FIG. 1, and the data lines DLD, DLE, DLF, and DLG may be driven based on the second timing controller 250 in FIG. 1. When the subpixels B1 and B3 disposed near (e.g., adjacent) the boundary area between the first display area A1 and the second display area A2 are turned on, the subpixel B1 may be driven based on a data voltage applied to the data line DLD, and the subpixel B3 may be driven based on a data voltage applied to the data line DLC. Thus, when data for driving the subpixel B1 is transmitted from the first timing controller 200 in FIG. 1 to the second timing controller 250 in FIG. 1, and when the data voltage corresponding to such data for driving the subpixel B1 is applied to the data line DLD, the boundary image may be efficiently displayed on the boundary area.

Figure 10:
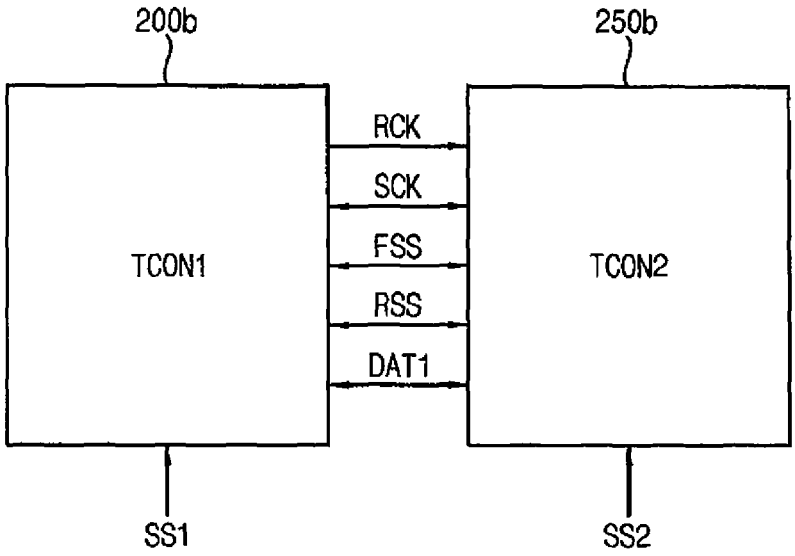
FIGS. 10 and 11 are block diagrams illustrating timing controllers included in the display apparatus according to example embodiments.
Figure 11:
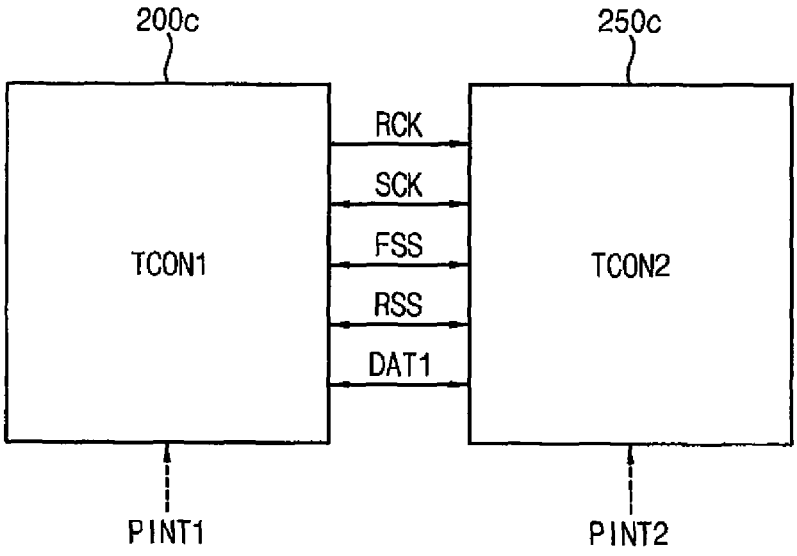

FIGS. 10 and 11 are block diagrams illustrating timing controllers included in the display apparatus according to some example embodiments.

Referring to FIG. 10, first and second timing controllers 200*b* and 250*b* are synchronized with each other based on a first reference clock signal RCK, and exchange first data DAT1 with each other based on a synchronization clock signal SCK. The first and second timing controllers 200*b* and 250*b* may be further synchronized with each other based on at least one selected from a first synchronization signal FSS and a second synchronization signal RSS.

The first timing controller 200*b* may operate as the master and the second timing controller 250*b* may operate as the slave. In this case, the first timing controller 200*b* may receive a first setting signal SS1 for determining the first timing controller 200*b* as the master. The second timing controller 250*b* may receive a second setting signal SS2 for determining the second timing controller 250*b* as the slave.

For example, the first and second setting signals SS1 and SS2 may be provided from an external device (e.g., a host).

In some example embodiments, the first timing controller 200*b* may be determined as the slave based on the first setting signal SS1, and the second timing controller 250*b* may be determined as the master based on the second setting signal SS2.

Referring to FIG. 11, first and second timing controllers 200*c* and 250*c* are synchronized with each other based on a first reference clock signal RCK, and exchange first data DAT1 with each other based on a synchronization clock signal SCK. The first and second timing controllers 200*c* and 250*c* may be further synchronized with each other based on at least one selected from a first synchronization signal FSS and a second synchronization signal RSS.

The first timing controller 200*c* may operate as the master and the second timing controller 250*c* may operate as the slave. In this case, the first timing controller 200*c* may be determined as the master based on a first internal parameter PINT1. The second timing controller 250*c* may be determined as the slave based on a second internal parameter PINT2. For example, the first and second internal parameters PINT1 and PINT2 may not be provided from the external device, but may be stored in an internal storage (e.g., an EEPROM). The first and second internal parameters PINT1 and PINT2 may be loaded from the internal storage during the initializations described above with reference to FIG. 7.

In some example embodiments, the first timing controller 200*c* may be determined as the slave based on the first internal parameter PINT1, and the second timing controller 250*c* may be determined as the master based on the second internal parameter PINT2.

Figure 12:
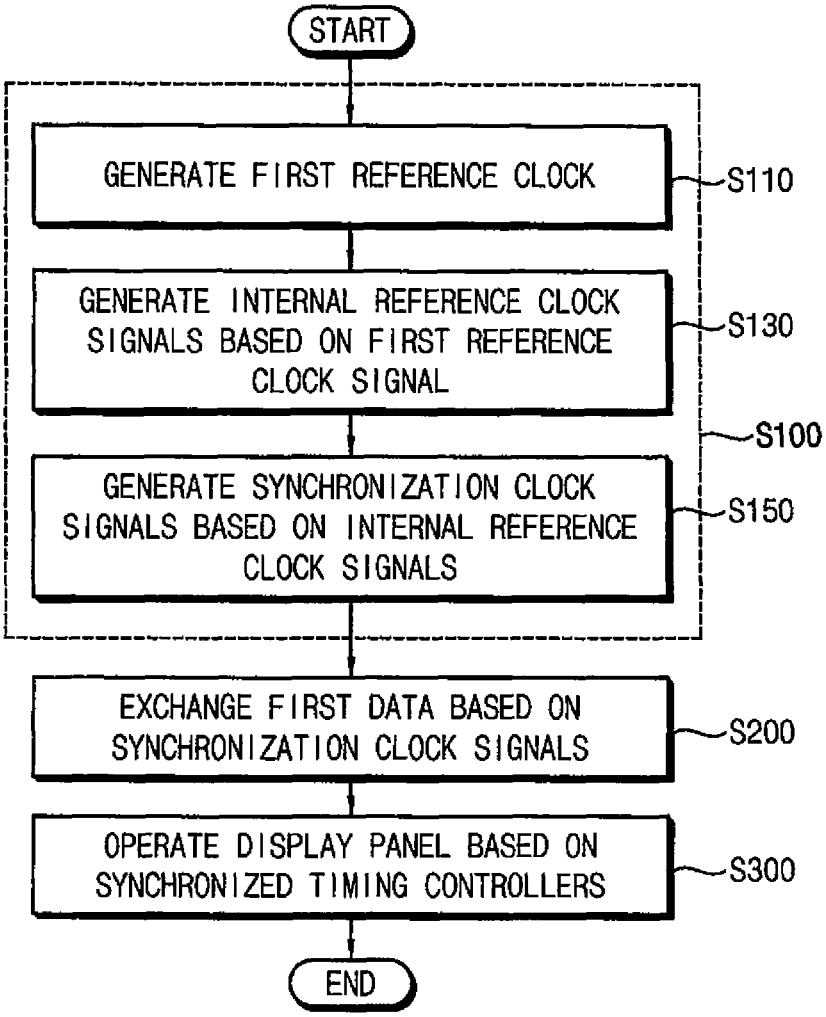
FIG. 12 is a flow chart illustrating a method of operating a display apparatus according to example embodiments.

FIG. 12 is a flow chart illustrating a method of operating a display apparatus according to some example embodiments.

Referring to FIGS. 1, 2, and 12, in the method of operating the display apparatus 10 according to some example embodiments, the first and second timing controllers 200 and 250 are synchronized with each other based on the first reference clock signal RCK (block S100). The first timing controller 200 controls the operation of the first display area A1 of the display panel 100, and the second timing controller 250 controls the operation of the second display area A2 of the display panel 100. For example, the first timing controller 200, which operates as the master, generates the first reference clock signal RCK (block S110). The first and second timing controllers 200 and 250 generate the first and second internal reference clock signals IRCK1 and IRCK2, respectively, based on the first reference clock signal RCK (block S130). The first and second timing controllers 200 and 250 generate the first and second synchronization clock signals SCK1 and SCK2 based on the first and second internal reference clock signals IRCK1 and IRCK2, respectively (block S150).

The first and second timing controllers exchange the first data DAT1 with each other based on the first and second synchronization clock signals SCK1 and SCK2 (block S200). For example, the first data DAT1 may include image data (e.g., data corresponding to a boundary image that is displayed on a boundary area between the first display area A1 and the second display area A2), test pattern data, dithering data, data for an inversion driving scheme, data for any synchronization operation, etc.

The display panel 100 operates based on the synchronized first and second timing controllers 200 and 250 (block S300).

In some example embodiments, the first data DAT1 may be transmitted from the first timing controller 200 to the second timing controller 250. In this case, the first timing controller 200 may output the first data DAT1 based on the first synchronization clock signal SCK1. The second timing controller 250 may perform the data capture operation on the first data DAT1 based on the first synchronization clock signal SCK1, the second internal reference clock signal IRCK2, and the second synchronization clock signal SCK2. The data capture operation for the first data DAT1 may be the multi-phase capture operation.

In some example embodiments, the first and second timing controllers 200 and 250 may be further synchronized with each other based on at least one selected from a first synchronization signal FSS in FIG. 5 and a second synchronization signal RSS in FIG. 5. In addition, each of the first and second timing controllers 200 and 250 may be determined as one of the master and the slave based on the first and second setting signals SS1 and SS2 in FIG. 10 that are provided from the external device, or based on the first and second internal parameters PINT1 and PINT2 in FIG. 11 that are stored in the internal storage.

Although the example embodiments are described based on the example where the display apparatus includes two timing controllers, the example embodiments may be employed to an example where a display apparatus includes at least three timing controllers that are synchronized with each other.

The above described embodiments may be used in a display apparatus and/or a system including the display apparatus, such as a mobile phone, a smart phone, a personal digital assistants (PDA), a portable multimedia player (PMP), a digital camera, a digital television, a set-top box, a music player, a portable game console, a navigation device, a personal computer (PC), a server computer, a workstation, a tablet computer, a laptop computer, a smart card, a printer, etc.

The foregoing is illustrative of example embodiments of the inventive concept and is not to be construed as limiting thereof. Although a few example embodiments have been described, those skilled in the art will readily appreciate that various modifications are possible in the example embodiments without materially departing from the spirit and scope of the present inventive concept. Accordingly, all such modifications are intended to be included within the spirit and scope of the present inventive concept as defined in the claims, and their equivalents. Therefore, it is to be understood that the foregoing is illustrative of various example embodiments, and is not to be construed as limited to the specific example embodiments disclosed herein, and that various modifications to the disclosed example embodiments, as well as other example embodiments, are intended to be included within the spirit and scope of the appended claims, and their equivalents.

What is claimed is:

1. A display apparatus comprising:

a display panel comprising a first display area and a second display area;

a first timing controller configured to control an operation of the first display area, to generate a first reference clock signal, to generate a first internal reference clock signal based on the first reference clock signal, and to generate a first synchronization clock signal based on the first internal reference clock signal; and a second timing controller configured to control an operation of the second display area, to receive the first reference clock signal, to generate a second internal reference clock signal based on the first reference clock signal, and to generate a second synchronization clock signal based on the second internal reference clock signal, wherein the first and second timing controllers are configured to be synchronized with each other based on the first reference clock signal, and to exchange first data with each other based on the first and second synchronization clock signals.

2. The display apparatus of claim 1, wherein the first timing controller is configured to output the first data based on the first synchronization clock signal, and the second timing controller is configured to perform a data capture operation on the first data based on the first synchronization clock signal, the second internal reference clock signal, and the second synchronization clock signal, when the first data is transmitted from the first timing controller to the second timing controller.

3. The display apparatus of claim 2, wherein each of the first and second internal reference clock signals has a frequency that is higher than a frequency of the first reference clock signal, each of the first and second synchronization clock signals has a frequency that is lower than the frequency of each of the first and second internal reference clock signals, and the data capture operation comprises a multi-phase capture operation.

4. The display apparatus of claim 1, wherein the second timing controller is configured to output the first data based on the second synchronization clock signal, and the first timing controller is configured to perform a data capture operation on the first data based on the first synchronization clock signal, the first internal reference clock signal, and the second synchronization clock signal, when the first data is transmitted from the second timing controller to the first timing controller.

5. The display apparatus of claim 1, wherein the first and second timing controllers are further configured to be synchronized with each other based on a first synchronization signal indicating that at least one selected from the first and second timing controllers enters a fail mode.

6. The display apparatus of claim 5, wherein the first synchronization signal is activated when at least one selected from the first and second timing controllers enters the fail mode, and wherein the display apparatus is configured to enter a system fail mode based on the activated first synchronization signal.

7. The display apparatus of claim 1, wherein the first and second timing controllers are further configured to be synchronized with each other based on a first synchronization signal indicating that both the first and second timing controllers are initialized.

8. The display apparatus of claim 7, wherein the first synchronization signal is activated when initializations for both the first and second timing controllers are completed, and wherein the first synchronization signal is deactivated when a vertical synchronization for the display panel is completed after the initializations for both the first and second timing controllers are completed.

9. The display apparatus of claim 8, wherein the first synchronization signal is periodically activated, and horizontal synchronizations for rows of the display panel are performed after the vertical synchronization for the display panel is completed.

10. The display apparatus of claim 8, wherein the first data includes first image data, and the first timing controller is configured to transmit the first image data to the second timing controller based on the first synchronization clock signal while the first synchronization signal is activated.

11. The display apparatus of claim 10, wherein the first image data corresponds to a boundary image that is displayed on a boundary area between the first display area and the second display area.

12. The display apparatus of claim 1, wherein the first timing controller is configured to operate as a master, and the second timing controller is configured to operate as a slave.

13. The display apparatus of claim 12, wherein the first timing controller is configured to receive a first setting signal for determining the first timing controller as the master, and the second timing controller is configured to receive a second setting signal for determining the second timing controller as the slave.

14. The display apparatus of claim 12, wherein the first timing controller is configured to be determined as the master based on a first internal parameter, and the second timing controller is configured to be determined as the slave based on a second internal parameter.

15. The display apparatus of claim 1, wherein the first timing controller comprises:

a first oscillator configured to generate the first reference clock signal;

a first phase locked loop (PLL) configured to generate the first internal reference clock signal based on the first reference clock signal;

a first synchronization clock signal generator configured to generate the first synchronization clock signal based on the first internal reference clock signal;

a first data processing unit configured to perform a data processing operation based on the first internal reference clock signal and the first synchronization clock signal; and a first input/output (I/O) unit configured to output the first reference clock signal, and further configured to output the first data based on the first synchronization clock signal, or to receive the second synchronization clock signal and the first data.

16. The display apparatus of claim 1, further comprising:

at least one first data driver connected to the first timing controller and a plurality of first data lines in the first display area, the at least one first data driver configured to generate a plurality of first data voltages to apply the plurality of first data voltages to the plurality of first data lines; and at least one second data driver connected to the second timing controller and a plurality of second data lines in the second display area, the at least one second data driver configured to generate a plurality of second data voltages to apply the plurality of second data voltages to the plurality of second data lines.

17. A method of operating a display apparatus comprising a display panel comprising a first display area and a second display area, the method comprising:

synchronizing a second timing controller with a first timing controller based on a first reference clock signal, the first timing controller controlling an operation of the first display area, and the second timing controller controlling an operation of the second display area; and operating the display panel based on the synchronized first and second timing controllers, wherein the synchronizing of the first and second timing controllers comprises:

generating, by the first timing controller, the first reference clock signal;

generating, by the first timing controller, a first internal reference clock signal based on the first reference clock signal, and generating, by the second timing controller, a second internal reference clock signal based on the first reference clock signal; and generating, by the first timing controller, a first synchronization clock signal based on the first internal reference clock signal, and generating, by the second timing controller, a second synchronization clock signal based on the second internal reference clock signal, and wherein the first and second timing controllers exchange first data with each other based on the first and second synchronization clock signals.

18. The method of claim 17, wherein when the first data is transmitted from the first timing controller to the second timing controller, the first timing controller outputs the first data based on the first synchronization clock signal, and the second timing controller performs a data capture operation on the first data based on the first synchronization clock signal, the second internal reference clock signal, and the second synchronization clock signal.

19. The method of claim 18, wherein each of the first and second internal reference clock signals has a frequency that is higher than a frequency of the first reference clock signal, each of the first and second synchronization clock signals has a frequency that is lower than the frequency of each of the first and second internal reference clock signals, and the data capture operation comprises a multi-phase capture operation.

20. The method of claim 17, wherein the first and second timing controllers are further synchronized with each other based on at least one selected from a first synchronization signal and a second synchronization signal, the first synchronization signal indicating that at least one selected from the first and second timing controllers enters a fail mode, and the second synchronization signal indicating that both the first and second timing controllers are initialized.

* * * * *